US007344355B2

(12) United States Patent
Wilshaw

(10) Patent No.: US 7,344,355 B2
(45) Date of Patent: Mar. 18, 2008

(54) VARIABLE STATOR VANE ASSEMBLIES

(75) Inventor: Johnathan Harvey Wilshaw, Stone (GB)

(73) Assignee: Rolls-Royce plc, London (GB)

( * ) Notice: Subject to any disclaimer, the term of this patent is extended or adjusted under 35 U.S.C. 154(b) by 580 days.

(21) Appl. No.: 11/074,706

(22) Filed: Mar. 9, 2005

(65) Prior Publication Data

US 2005/0232758 A1 Oct. 20, 2005

(30) Foreign Application Priority Data

Apr. 7, 2004 (GB) ..... 0408028.9

(51) Int. Cl.
*F01D 9/02* (2006.01)

(52) U.S. Cl. ..... 415/160; 415/209.3

(58) Field of Classification Search ..... 415/160, 415/191, 209.3, 209.4, 210.1
See application file for complete search history.

(56) References Cited

U.S. PATENT DOCUMENTS 4,514,141 A 4/1985 Marey
4,732,536 A 3/1988 Lejars et al.
4,979,874 A 12/1990 Myers
6,019,574 A * 2/2000 DiBella ..... 415/160
6,471,471 B1 10/2002 Bouyer
6,802,692 B2 * 10/2004 Bouru ..... 415/160
7,198,461 B2 * 4/2007 Burgmeier et al. ..... 415/160

FOREIGN PATENT DOCUMENTS

EP 1 335 112 A1 8/2003

* cited by examiner

*Primary Examiner*—Ninh H. Nguyen
(74) *Attorney, Agent, or Firm*—Oliff & Berridge, PLC

(57) ABSTRACT

A variable stator vane assembly 10 where two downwardly inclined engagement faces 30 are provided on the top of the stator vane upper stem 14, extending for part of the width thereof. A pair of projections 36 with inwardly inclined surfaces 38 are provided on the underside of the lever arm 16. The surfaces 38 are only engageable with the faces 30 in one axial alignment, and otherwise the lever arm 16 will be raised relative to the stator vane 12 to clearly indicate incorrect mounting thereon.

12 Claims, 2 Drawing Sheets

VARIABLE STATOR VANE ASSEMBLIES

This invention concerns improvements in or relating to variable stator vane assemblies.

The compressor of a conventional gas turbine engine, as used for example on jet aircraft, comprises a number of rows of stator vanes and corresponding rotor blades. At least some of these stator vanes may be variable stator vanes which can be rotated about a radial direction to provide a desired air angle onto the following rotor blades at different engine speeds. Typically variable stator vanes are connected by a bolt to one end of a respective lever arm, with the other end of the lever arm pivotally mounted to a ring. The ring can be moved about the engine's axis to vary the inclination of the vanes.

It is sometimes necessary to remove the blade retention bolt, for instance to allow instrumentation to be fitted during testing. When the bolt is replaced it is important to ensure that the correct relative alignment between the stator vane and lever arm has been retained. Otherwise with a misalignment, a once-per-revolution aerodynamic excitation can occur, leading to disc post cracking and failure.

The direction upper when used in this specification is to be understood as meaning radially outwards, and other terms such as top and underside, are to be correspondingly understood.

According to the present invention there is provided a variable stator vane assembly for a gas turbine engine, the assembly including a stator vane with an airfoil and an upper stem section extending therefrom, a lever arm engagable on an upper surface of the upper stem when mounted to the stator vane, and retaining means for retaining the lever arm mounted on the stator vane, the upper surface having a formation with at least one engagement face extending below at least part of the remainder of the formation, said engagement face not extending wholly around the central axis of the stator vane, a corresponding projecting formation on the underside of the lever arm, which projecting formation is engageable against said engagement face when the lever arm is mounted on the stator vane, the projecting formation and engagement face being arranged such that there is only full mounting of the lever arm on the stator vane at one respective axial orientation therebetween, such that at any other axial orientation the lever arm will be spaced upwardly relative to the full mounting position.

The engagement face is preferably inclined about a line extending horizontally across the top of the upper stem. Two oppositely inclined engagement faces may be provided, and desirably the engagement faces are inclined downwardly and outwardly. The top edges of the engagement faces may be substantially parallel and spaced from each other to define an upper strip therebetween.

The engagement faces preferably only extend for part of the width of the upper surface, and the remainder of the width of the upper surface is preferably substantially horizontal, and desirably coplanar with the upper strip.

The upper stem section is preferably substantially circular in cross section.

The retaining means may include alignable holes in the stator vane and lever arm, and a bolt extendable through the hole in the lever arm and engageable in the hole in the stator vane to retain the lever arm thereon.

The hole in the upper stem may be off centre. The top edges of the engagement faces may extend in substantially equispaced alignment from the centre of the hole in the upper stem.

Lateral abutment faces are preferably provided on the upper stem where the edge of the engagement faces meet the remainder of the upper surface.

The lever arm preferably includes a pair of projecting formations which each include an inwardly facing inclined surface engageable against, and substantially parallel to, a respective engagement face on the stator vane, when the lever arm is mounted thereon.

The lever arm and stator vane may be arranged such that when mounted together substantially only the inclined surfaces on the lever arm and the engagement faces on the stator vane are engageable with each other.

The invention also provides a compressor for a gas turbine engine, the compressor including a plurality of variable stator vane assemblies according to any of the preceding nine paragraphs.

An embodiment of the present invention will now be described by way of example only and with reference to the accompanying drawings, in which.

Figure 1:
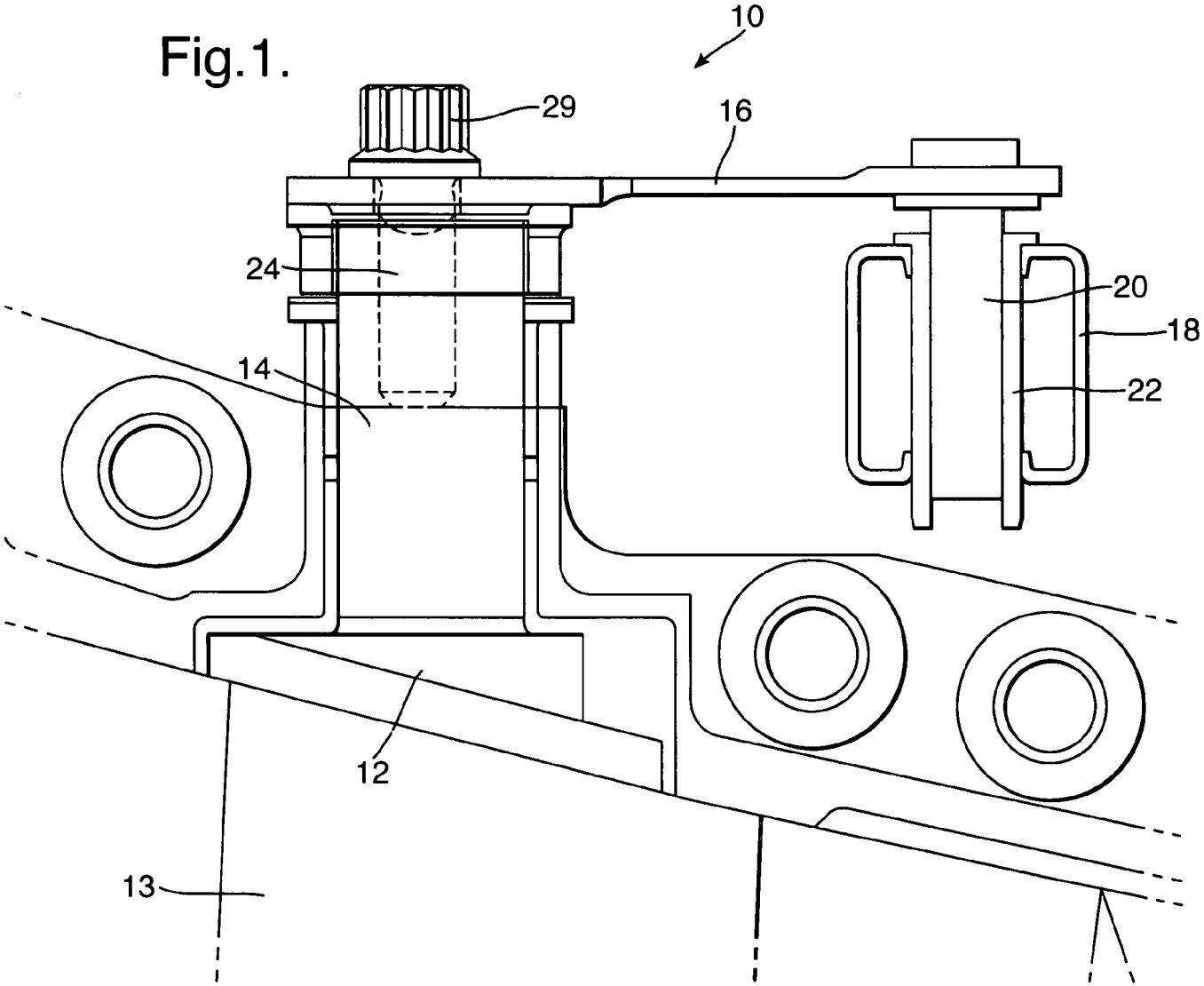
FIG. 1 is a diagrammatic side view of part of a variable stator vane assembly according to the invention.
Figure 2:
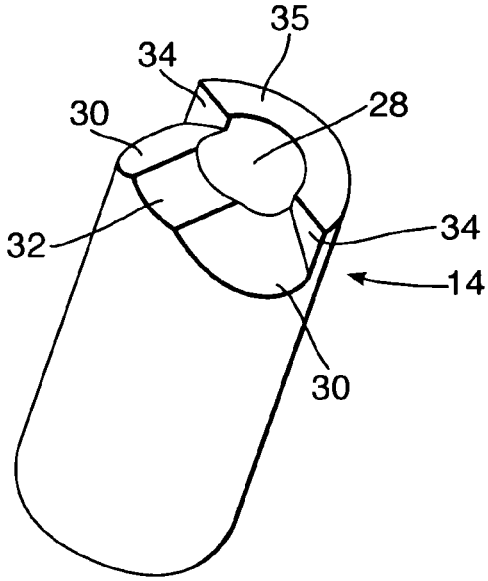
FIG. 2 is a diagrammatic perspective view of part of a first component of the assembly of FIG. 1.
Figure 3:
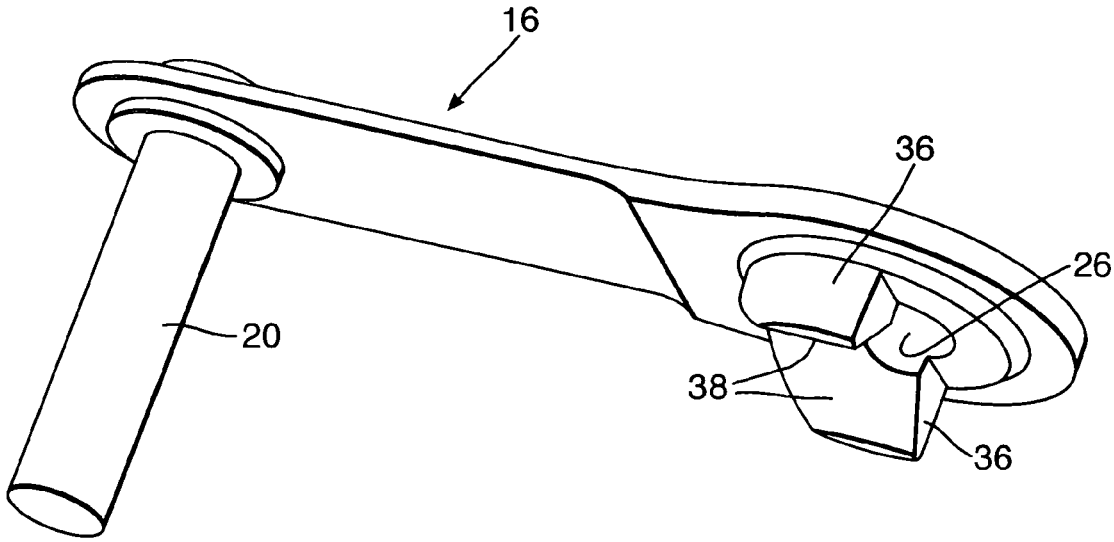
FIG. 3 is a diagrammatic perspective view of a second component of the assembly of FIG. 1.

The drawings show a variable stator vane assembly 10. The assembly comprises a stator vane 12 with an airfoil 13 from which an upper stem 14 extends. The upper stem 14 is mounted to one end of a lever arm 16. The other end of the lever arm 16 is pivotally mounted to a ring 18. The pivotal mounting is provided by a downwardly extending finger 20 on the lever arm 16, which finger 20 rotatably locates in a bushing 22 provided in a hole in the ring 18. Each ring 18 will mount a number of lever arms 16 circumferentially around the engine.

The lever arm 16 is mounted to the upper stem 14 by virtue of a bolt 24. The bolt 24 passes through an opening 26 in the lever arm 16, and threadably engages in an off centre hole 28 in the upper stem 14. The head 29 of the bolt 24 engages against the lever arm 16.

The upper surface of the upper stem 14 is profiled as follows. A pair of outwardly downwards inclined engagement faces 30 are provided. A flat horizontal strip 32 extends between the tops of the faces 30. The faces 30 are at a corresponding angle and symmetrical about a diametric line across the top of the generally cylindrical upper stem 12. The faces 30 extend through a little over half the width of the top of the stem 14. The faces 30 then meet vertical engagement faces 34 which extend upwardly to a horizontal section 35, coplanar with the strip 32.

The underside of the lever arm 16 around the opening 26 has a pair of projections 36 engageable respectively with the faces 30. The projections 36 extend a little over half the diameter of the opening 26 on either side thereof, and have inwardly facing inclined surfaces 38 engageable with the engagement faces 30 in a generally parallel alignment.

In use, the stator vane 12 and lever arm 16 are mounted together as shown in FIG. 1. These components are arranged such that when mounted together substantially only the engagement faces and respective engagement surfaces 38 are in contact with each other. The arrangement of the faces 30 and surfaces 38 reacts out the tightening torque of the bolt 24 being tightened against the lever arm 16 and stator vane 12. If an attempt is made to mount the lever arm 16 on the stator vane 12 at an incorrect alignment, the projections 36 will rest on the strip 32 and horizontal section 35, and thus the lever arm 16 will be significantly raised away from the stator vane 12, therefore providing a clear visual indication that the assembly 10 has not been correctly mounted together.

This arrangement thus only permits mounting together of the stator vane 12 and lever arm 16 in a correct alignment, and provides a clear visual indication if this alignment is not provided. The arrangement does not require significant extra machining relative to conventional arrangements without this feature, and thus does not provide a significant cost prohibition. The arrangement reacts out tightening torque so the lever arm does not tend to ride up relative to the stator vane. This arrangement provides engagement over a relatively large area of the inclined faces and surfaces, thereby avoiding the need to provide precise clearances and also avoiding any potential backlash.

It is to be realised that various modifications may be made without departing from the scope of the invention. For instance, retaining means other than the bolt described could be used. The engagement faces may have a different form.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A variable stator vane assembly for a gas turbine engine, the assembly including a stator vane with an airfoil and an upper stem section extending therefrom, a lever arm engagable on an upper surface of the upper stem when mounted to the stator vane and retaining means for retaining the lever arm mounted on the stator vane, characterised in that the upper surface has a formation with at least one engagement face extending below at least part of the remainder of the formation, said engagement face not extending wholly around the central axis of the stator vane, a corresponding projecting formation on the underside of the lever arm, which projecting formation is engageable against said engagement face when the lever arm is mounted on the stator vane, the projecting formation and engagement face being arranged such that there is only full mounting of the lever arm on the stator vane at one respective axial orientation therebetween, such that at any other axial orientation the lever arm will be spaced upwardly relative to the full mounting position.

2. An assembly according to claim 1, characterised in that the engagement face is inclined about a line extending horizontally across the top of the upper stem.

3. An assembly according to claim 1, characterised in that two oppositely inclined engagement faces are provided, and the engagement faces are inclined downwardly and outwardly.

4. An assembly according to claim 3, characterised in that the top edges of the engagement faces are substantially parallel and spaced from each other to define an upper strip therebetween.

5. An assembly according to claim 3, characterised in that the engagement faces only extend for part of the width of the upper surface, and the remainder of the width of the upper surface is preferably substantially horizontal, and desirably coplanar with the upper strip.

6. An assembly according to claim 3, characterised in that the top edges of the engagement faces extend in substantially equispaced alignment from the centre of the hole in the upper stem.

7. An assembly according to claim 3, characterised in that lateral abutment faces are provided on the upper stem where the edge of the engagement faces meet the remainder of the upper surface.

8. An assembly according to claim 3, characterised in that the lever arm includes a pair of projecting formations which each include an inwardly facing inclined surface engageable against, and substantially parallel to, a respective engagement face on the stator vane, when the lever arm is mounted thereon.

9. An assembly according to claim 8, characterised in that the lever arm and stator vane are arranged such that when mounted together substantially only the inclined surfaces on the lever arm and the engagement faces on the stator vane are engageable with each other.

10. An assembly according to claim 1, characterised in that the upper stem section is substantially circular in cross section.

11. An assembly according to claim 1, characterised in that the retaining means includes alignable holes in the stator vane and lever arm, and a bolt extendable through the hole in the lever arm and engageable in the hole in the stator vane to retain the lever arm thereon.

12. A compressor for a gas turbine engine, characterised in that the compressor includes a plurality of variable stator vane assemblies according to claim 1.

* * * * *